United States Patent [19]

Miyahara et al.

[11] Patent Number: 4,931,233

[45] Date of Patent: Jun. 5, 1990

[54] METHOD FOR ADDING ADDITIVES DURING MANUFACTURE OF CARBON FIBER

[75] Inventors: Naomasa Miyahara; Hiroyuki Nakamura; Takashi Ohsaki, all of Tokyo, Japan

[73] Assignee: Nikkiso Co., Ltd., Tokyo, Japan

[21] Appl. No.: 245,986

[22] Filed: Sep. 14, 1988

Related U.S. Application Data

[63] Continuation of Ser. No. 940,045, Dec. 10, 1986, abandoned, which is a continuation-in-part of Ser. No. 799,908, Sep. 25, 1985, abandoned.

[30] Foreign Application Priority Data

Sep. 26, 1984 [JP] Japan ..... 59-200967

[51] Int. Cl.[5] ..... D01F 9/22

[52] U.S. Cl. ..... 264/29.2; 264/130; 264/182; 264/206; 264/211.15; 264/233

[58] Field of Search ..... 264/29.2, 29.5, 130, 264/182, 206, 211.15, 233

[56] References Cited

U.S. PATENT DOCUMENTS

| | | | |
|---|---|---|---|
| 4,370,141 | 1/1983 | Lee et al. | 264/29.2 |
| 4,378,343 | 3/1983 | Suguira et al. | 264/29.2 |
| 4,452,601 | 6/1984 | Collins et al. | 264/29.2 |
| 4,473,372 | 9/1984 | Kuder et al. | 264/29.2 |
| 4,496,631 | 1/1985 | Adachi et al. | 264/29.2 |

*Primary Examiner*—Hubert C. Lorin

*Attorney, Agent, or Firm*—Browdy & Neimark

[57] ABSTRACT

In a method of manufacturing carbon fiber with less uniformity of physical strength in the longitudinal direction, an oil additive in a volatile medium is applied to an organic fiber after it is removed from a container and while the volatile medium has not completely evaporated from the fiber, and before the fiber is fed to a flameproofing furnace.

8 Claims, No Drawings

METHOD FOR ADDING ADDITIVES DURING MANUFACTURE OF CARBON FIBER

This application is a continuation of application Ser. No. 940,045, filed Dec. 10, 1986, now abandoned, which is a continuation-in-part of parent copending application Ser. No. 779,908, filed Sept. 25, 1985, now abandoned.

BACKGROUND OF THE INVENTION

This invention relates to a method for adding additives during the production of carbon fiber.

The manufacture of carbon fiber usually includes a step for stabilizing the organic fibers. When organic fiber is heated in a carbonizing furnace immediately to a temperature of, for example, 1,000°-1,800° C, the organic fiber undergoes a rapid exothermic reaction which results in breakage of fibers. In order to prevent this breakage of organic fibers, it is necessary to cause the organic fiber to gradually undergo oxidation and/or reduction. This necessity can be satisfied by stabilizing the organic fiber by heating it to a temperature of, for example, 180°-300° C.

Therefore in general spun organic fiber is stabilized to make it flameproof and then it is carbonized to produce carbon fiber.

In conventional methods for manufacturing carbon fiber, spun organic fiber is not immediately supplied to the stabilization step. Specifically, spun organic fiber is once either wound around a bobbin or shaken into a container until a given amount of the organic fiber is accumulated before it is made flameproof.

The reasons for separately spinning and then stabilizing the organic fiber are as follows:

(1) The spinning rate of polyacrylonitrilic organic fiber is 20-400 m/min. and that of pitch-based organic fiber is 200-1,000 m/min. Stabilizing organic fiber generally takes 0.5 -4 hours. In order to continuously feed spun organic fiber immediately to the stabilization step without breaking fibers, the rate of travel through a furnace used to make the organic fiber flameproof must equal the rate of production during the whole period of the above stabilization time and therefore the organic fiber must travel a distance of at most 240,000 m through the furnace. Use of a furnace with a length of at most 240,000 m is not possible industrially.

(2) If spun organic fiber is fed as it is to the stabilization step without being cut and then the flameproof fiber resulting from the stabilization process is continuously fed to the carbonizing process without being cut, when the travelling of the thread must be suspended in one of the above steps due to breakage of the thread or for other reason the feeding of the thread in the other steps must also be suspended. Therefore, only low manufacture efficiency can be achieved by supplying the organic fiber to the carbonizing step without cutting the fiber.

Accordingly, in conventional methods for manufacturing carbon fiber, spun organic fiber is accumulated until a given amount of the organic fiber is produced before the organic fiber is fed into a furnace in which the fiber is heated and made flameproof.

In addition, in conventional methods for manufacturing carbon fiber, aqueous solutions or emulsions of various types of additives are applied to the organic fiber at the end of spinning step.

These additives which are generally and collectively called oil, include an antistatic agent and a binder which are added for preventing any separation or fluffing of filaments which might result from e.g. static electrification of the spun organic fiber when it is used and for smoothly supplying the thread on a roller in order to secure production efficiency and stability. A parting agent for preventing the coalescence of filaments during the step for making the organic fiber flameproof by heating it in a furnace, an oxidation/reduction accelerator for accelerating a reaction for making the fiber flameproof during the stabilization step and a lubricant for preventing the fluffing of filaments during the carbonization process, and the like are occasionally added as additives at the end of spinning step.

However, despite the fact that various types of additives or oil is added to the fiber at the end of spinning step, the physical strength of carbon fiber produced by a conventional method is sometimes nonuniform.

PURPOSE OF THE INVENTION

The inventors have acquired the following knowledge about the physical strength of the resulting carbon fiber.

(1) When oil is applied to the organic fiber at the end of spinning step prior to shaking the thus moistened organic fiber into a container and then the above organic fiber is stored for a long period while being naturally dried without placing a lid over the container, carbon fiber produced by heating the organic fiber in a flameproof furnace and by carbonizing has reduced physical strength. When the organic fiber moistened by oil added at the end of spinning step is wound around a bobbin without being dried and then is stored as it is for a long period while being naturally dried, carbon fiber produced by heating the organic fiber in a flameproof furnace and by carbonizing also has reduced physical strength.

(2) When oil is added to the organic fiber at the end of spinning step prior to forcedly drying the moistened organic fiber and then the organic fiber is either shaken into a container or wound around a bobbin, the physical strength of carbon fiber produced by heating the organic fiber in a flameproof furnace and by carbonizing is not lowered.

When the fiber moistened by adding oil at the end of spinning step is shaken into a container and then a lid is placed over the container so that the moistened organic fiber is not dried, the physical strength of carbon fiber produced by heating the organic fiber in a flameproof furnace and by carbonizing is lowered. Because the added oil is dried naturally for several days by continuously shaking the organic fiber into the container, and uneven oil adhesion to the organic fiber occurs.

(3) When oil is applied to the organic fiber at the end of spinning step prior to shaking the organic fiber moistened by the oil into a container and then the organic fiber is stored while being naturally dried without placing a lid over the container, the physical strength of carbon fiber produced by heating the organic fiber in a flameproof furnace and by carbonizing decreases as the organic fiber is stored for a longer period.

(4) When oil is added to organic fiber, to which oil has not been added at the end of spinning step, immediately before the organic fiber is fed into a flameproof furnace and a carbonizing furnace, the physical strength of the resulting carbon fiber is not lowered.

This invention has been completed on the basis of the above knowledge.

A primary object of this invention is to solve the special problem resulting from natural drying occurring when additives are applied to the organic fiber at the end of spinning step prior to shaking the moistened organic fiber into a case without evaporating the additives and then the organic fiber is accumulated in a container without lid until an amount sufficient for the subsequent step for making the fiber flameproof has been produced.

Another object of this invention is to provide a method for homogeneously applying various types of additives to the organic fiber before it is subjected to the stabilization step in order to produce strong carbon fiber.

A further object of this invention is to provide a method for manufacturing carbon fiber with less nonuniformity of physical strength in the longitudinal direction.

SUMMARY OF THE INVENTION

The invention concerns a method for adding additives during the production of carbon fiber by continuously feeding the organic fiber having been shaken into a container at the end of spinning step into a furnace for making the fiber flameproof through an oil applicator.

In the method of this invention, in order to produce carbon fiber with great and uniform physical strength, additives used for improving the production efficiency and the ease of use of carbon fiber are homogeneously applied to the organic fiber between the above container and the above furnace.

DETAILED DESCRIPTION OF THE INVENTION

It is not clear why the physical strength of the resulting carbon fiber is lower than that of the conventional one when the organic fiber to which additives have been applied at the end of spinning step is shaken into a container without evaporating the additives and then the organic fiber in the container is left as it is for a long period without placing a lid over the container.

The inventors infer that shaking the organic fiber moistened by additives added at the end of spinning step into a container and then leaving the moistened organic fiber for a long period without placing a lid over the container results in a difference between the contents of the additives in the surface and the core of the organic fiber accumulation thereby causing reduced physical strength of the carbon fiber.

This inference is based on the following facts. That is to say, when a dye solution instead of additives is applied to the organic fiber at the end of spinning step prior to shaking the moistened organic fiber into a container and then the organic fiber in the container is left without placing a lid over the container, as the organic fiber dries the color of the surface of the organic fiber accumulation becomes deeper. Deepened color of organic fibers in the surface of the accumulation indicates that the dye has gradually diffused and migrated from the core to the surface of the accumulation. This result demonstrates the fact that as the moistened organic fiber shaken into the container dries with the passing of time during storage a difference arises between the amounts of the additives adhering to the surface and the core of the organic fiber accumulation.

It is not clear why nonuniform distribution of the additives adhering to the organic fiber results in nonuniform physical strength of the carbon fiber. However, the inventors infer that nonuniform distribution of the additives adhering to the organic fiber influences the flameproof property of the stabilized organic fiber.

As mentioned above, this invention has been completed on the basis of the inference that leaving the organic fiber moistened by additives added at the end of spinning step in a container without a lid for a long period results in nonuniform distribution of the additives adhering to the organic fiber in the container thereby causing reduced physical strength of the carbon fiber.

This invention is a method for adding additives during the production of carbon fiber by continuously feeding the organic fiber, which has been shaken into a container during spinning, through an oil applicator and into a furnace for making the fiber flameproof.

It is thought that, even when additives are applied to the organic fiber at the end of spinning step, homogeneous fixation of the additives to the organic fiber can be achieved by drying it during spinning. However, a step of drying the moistened organic fiber after the spinning step requires an increased number of processes and increased energy and therefore is not carried out.

There is no special restriction on the above organic fiber and any original material useful for carbon fiber production can be used. With respect to the physical strength and the elasticity of the carbon fiber, polyacrylic organic fiber can be preferably used as the organic fiber for this invention.

It should be noted that the physical strength of the resulting carbon fiber differs according to which one of the following procedures is adopted.

(1) After a dispersion or solution of additives in a solvent is applied to the organic fiber at the end of spinning step and the solvent is completely evaporated, the organic fiber is either shaken into the container or wound around a bobbin.

(2) After a dispersion or solution of additives in a solvent is applied to the organic fiber during spinning, the moistened organic fiber is immediately fed into a furnace without evaporating the solvent to make the organic fiber flameproof.

(3) After a dispersion or solution of additives in a solvent is applied to the organic fiber at the end of spinning step, the moistened organic fiber is left in the container for a long period without completely evaporating the solvent and then that organic fiber is supplied into a furnace to make the fiber flameproof.

Adopting the above procedure (2) does not result in production of carbon fiber with reduced physical strength since nonuniform distribution of the additives adhering to the organic fiber does not occur which is the problem that should be solved by this invention.

Adopting the above procedure (3) results in production of carbon fiber with reduced physical strength.

When the above procedure (1) is adopted, it is difficult to shake the organic fiber into a container because no filaments are bound together and the filaments of the fiber are very light. Moreover, although no problem arises from winding dried fibers around a bobbin, fluffing of the organic fiber occurs during feeding the organic fiber from the bobbin into the carbonization step. This problem can be solved by twisting the organic fibers before they are wound around the bobbin. But, feeding the twisted organic fibers into the carbonization step results in minimal radiation of reaction heat during this step thereby reducing the quality of the resulting carbon fiber.

The method of this invention which aims at homogeneously fixing additives to the organic fiber in order to prevent production of carbon fiber with reduced physical strength, can be applied to organic fiber to which no additives have been applied at the end of spinning step prior to shaking the organic fiber into a container.

The above additives added to the organic fiber between the storage container and the furnace used in the process of making the organic fiber flameproof, are those necessary for improving the properties of the resulting carbon fiber and for securing the processing efficiency and the stability of the spun organic fiber. They consist of the same types of additives as those which have been conventionally used in the carbonizing step and they are generally called oil.

The additives preferably used in this invention can be grouped by their effect into parting agents, antistatic agents, lubricants, oxidation/reduction accelerators and binders. They can be grouped by their name into silicone oils and its epoxidation products, low or high molecular phosphoric esters, low or high molecular sulfuric esters, low or high molecular fatty acid metal salts, polyalkylene oxides, and alkylamide derivatives. Some of these compounds are cationic surfactants, anionic surfactants or nonionic surfactants.

Of these compounds, it is preferable to use high molecular phosphoric esters such as polyoxyethylenealkyl phosphates and polyoxyethylene phosphonate or silicone oils such as dialkyl polysiloxanes. And it is more preferable to use polyoxyethylene phosphonate or dimenthyl polysiloxane.

The above phosphoric ester or silicone oil can not only prevent the fluffing or electrification of the organic fiber during either the step for making the organic fiber flameproof or the carbonization step but also achieve improved and uniform physical strength of the carbon fiber.

These additives are added to the organic fiber after being dissolved, emulsified or dispersed in a volatile medium.

Water and alcohols such as methyl alcohol and ethyl alcohol can be used as volatile media.

Although a more volatile medium can also be used, use of a more volatile medium is not recommended because it increases the possibility of fire or poisoning occurring in the factory.

Accordingly, it is desirable in terms of safety and ease of use to add an aqueous emulsion of the above additives to the above organic fiber.

The amount of the additives dissolved, emulsified or suspended in the above volatile medium is usually 0.1–5% preferably 0.3–2% of the total amount of the resulting liquid.

Concentration of the additives in the liquid lower than the above range will results in only insufficient effect. When the concentration of the additives exceeds the above range, the produced effect may not proportional to the amount of the additives added.

In the method of this invention, the above additives are applied to the above organic fiber by using an oil applicator to make the above organic fiber in contact with a solution, an emulsion or a suspension of the above additives in the above volatile medium.

The structure of the above oil applicator can be variously modified according to the process for the above contact treatment as follows.

(1) Immersing the organic fiber in the above solution, emulsion or suspension and then as necessary passing the fiber over a roller to remove surplus liquid by using an oil applicator which has a container containing the above liquid and as necessary also has the roller.

(2) Feeding the organic fiber while making it in contact with the upper peripheral surface of a roller by using an oil applicator which has a container containing the above liquid and also has the roller which is rotated by a driving mechanism and the lower peripheral surface of which is immersed in the above liquid.

It is possible to properly use one of the other typical oil applicators to perform the above contact treatment. It is preferable to use the oil applicator used in the above process (1).

The oil applicator is used to apply oil to the organic fiber between the above container and a furnace for making the fiber flameproof.

The organic fiber to which the additives have been applied by the above procedure may be dried to evaporate the volatile medium from the surfaces of organic fibers. But, it is recommended to feed the moistened organic fiber through a furnace to make the fiber flameproof. During this step for making the organic fiber flameproof, the organic fiber is dried in the furnace.

The organic fiber to which additives have been applied are made flameproof and the carbonized by conventional well-known methods.

According to the method of this invention in which additives are applied to the spun organic fiber between the storage container and the step for making the organic fiber flameproof, there is no possibility that the additives gradually diffuse or migrate in the organic fiber as the solvent evaporates. As a result, the generation of nonuniform adhesion of the additives to the organic fiber is prevented, thereby achieving homogeneous adhesion of the additives to the organic fiber. Homogeneous application of the additives to the organic fiber enables the additives to exhibit their full effect and also makes the organic fiber uniformly flameproof thereby achieving production of carbon fiber with improved and uniform physical strength.

In the following, preferable examples of this invention will be described.

EXAMPLE 1

A spinning solution (viscosity of 250 poises at 45° C) was prepared by dissolving 6 pts. of polyacrylic polymers with a mean molecular weight of 120,000 containing 1% of itaconic acid and 2% of methylmethacrylate in 94 pts. of a 60% aqueous zinc-chloride solution. Next, the thus prepared spinning solution was extruded through a spinning nozzle with 3,000 holes into a 30% aqueous zinc-chloride solution maintained at 0° C (coagulation bath) to produce a fibrous material which is then washed by water and expanded in hot water before being dried and expanded in steam thereby producing polyacrylonitrilic organic fiber.

The ratio of the running velocity of fiber tow at the outlet of the coagulation bath to the linear velocity of the spinning solution in the holes of spinning nozzle was adjusted to 1.5. The ratio of the rate of the travel of the solution through the outlet of the coagulation bath to the rate of the travel of the solution after being expanded in steam was adjusted to 14.0.

A 3,000 m portion of the above polyacrylonitrilic organic fiber was shaken into a container, thereby making sample 1.

After the above polyacrylonitrilic organic fiber expanded in steam was immersed in a 2% aqueous emulsion of dimethyl polysiloxane (trade name, "Silicone Softener 318" manufactured by Matsumoto Yushi Pharmaceutical Co., Ltd.), surplus emulsion adhering to the impregnated fiber was squeezed from it and then a 3,000 m portion of the moistened fiber was shaken into a container, thereby making sample 2 (reference).

These samples 1 and 2 were then treated under a condition of 85° C and 95% RH for 60 minutes to relax them.

Next, sample 2 was made flameproof feeding it into a stabilization furnace.

The amount of oil adhering to sample 2 five days following spinning (before the above loosening treatment) was calculated by measuring the reduction in the weight of sample 2 resulting from washing it by dichloromethane. As the result, it was found that the surface of the accumulation of sample 2 contained 2.1% of oil while its core contained 0.4% of oil. This result indicates that inhomogeneous distribution of the additives occured during the time when the organic fiber still moistened by water was accumulated and left in the container for a long time after being shaken into the container.

Sample 1 was immersed in a 2% aqueous emulsion of dimethyl polysiloxane (trade name, "Silicone softener 318" manufactured by Matsumoto Yushi Pharmaceutical Co., Ltd.) and then surplus emulsion adhering to impregnated sample 1 was squeezed from it. After that, moistened sample 1 was stabilized by feeding it into a furnace the temperature of the internal air of which gradually changes (220° C, 250° C, 260° C and 270° C) from the inlet to the outlet. Moistened sample 1 was fed through the furnace in such a manner as to cause an arbitrary point to which a tension of 700 g was applied to pass through the furnace in 60 minutes.

The thus treated sample 1 was then passed through a carbonizing furnace maintained at 1,400° C, thereby producing carbon fiber.

The average strand strength of carbon fiber samples (JIS R 7601, 40 samples) produced from sample 1 was 420 kg/mm$^2$ and the standard deviation was 21 kg/mm$^2$.

The average strand strength of carbon fiber samples (JIS R 7601, 40 samples) produced from sample 2 was 380 kg/mm$^2$ and the standard deviation was 48 kg/mm$^2$.

As seen from these results, carbon fiber produced by the method of this invention has increased and uniform physical strength.

EXAMPLE 2

An experiment was performed in the same manner as in Example 1 except that a 1% aqueous emulsion of polyoxyethylene sulfonate was used instead of a dimethyl polysiloxane emulsion.

The amount of polyoxyethylene sulfonate added during spinning and adhering to the organic fiber was calculated by using an extraction liquid composed of ethyl alcohol and benzene in a ratio by volume of 2:1. The surface of the accumulation of sample 2 (reference) contained 0.9% of oil while its core contained 0.3% of oil.

The average strand strength of carbon fiber samples (JIS R 7601, 40 samples) produced from sample 1 was 452 kg/mm$^2$ and the standard deviation was 20 kg/mm$^b$ 2.

The average strand strength of carbon fiber samples (JIS R 7601, 40 samples) produced from sample 2 was 402 kg/mm$^2$ and the standard deviation was 32 kg/mm$^2$.

What is claimed is:

1. In a process for production of carbon fiber which comprises spinning organic fiber, water-expanding said spun organic fiber accumulating the expanded spun organic fiber in a container without a lid for prevention of drying, taking out the accumulated organic fiber from said container and feed said organic fiber from said container and feeding said organic fiber to a flameproofing furnace and then feeding the organic fiber to a carbonizing furnace, the improvement comprising applying an oil additive in a volatile medium to the organic fiber after said organic fiber is removed from the container and while the volatile medium has not completely evaporated from the fiber and before said organic fiber is fed to the flameproofing furnace.

2. A method as set forth in claim 1 wherein said organic fiber is polyacrylonitrilic organic fiber.

3. A method as set forth in claim 1, wherein said oil applicator is used to apply at least one oil additive selected from the group consisting of anticoagulants, antistatic agents, lubricants, oxidation/reduction accelerators and binders.

4. A method as set forth in claim 3 wherein said oil additives are at least one of a silicone oil or its epoxidation product, a low or high molecular phosphoric ester, a low or high molecular sulfuric ester, a low or high molecular fatty acid metal salt, a polyalkylene oxide and an alkylamidic derivative.

5. A method as set forth in claim 3 wherein said oil additive is either a high molecular phosphoric ester or a silicone oil.

6. A method as set forth in claim 3 wherein said oil additive is either polyoxyethylene phosphonate or dimethyl polysiloxane.

7. A method as set forth in claim 3 wherein an aqueous emulsion of said oil additives is applied to the organic fiber.

8. A method as set forth in claim 7 wherein the concentration of the additives in said oil aqueous emulsion is 0.1–5%.

* * * * *